United States Patent [19]

Iannucci et al.

[11] 4,372,191

[45] Feb. 8, 1983

[54] ROTARY BRAIDING MACHINE

[75] Inventors: Vincent A. Iannucci, West Lawn; Rudolf H. Haehnel, Reading, both of Pa.

[73] Assignee: Rockwell International Corp., Pittsburgh, Pa.

[21] Appl. No.: 357,395

[22] Filed: Mar. 12, 1982

[51] Int. Cl.[3] ..... D04C 3/42

[52] U.S. Cl. ..... 87/48

[58] Field of Search ..... 87/33, 36, 44, 48, 50

[56] References Cited

U.S. PATENT DOCUMENTS

| | | | |
|---|---|---|---|
| 1,976,931 | 10/1934 | Ford | 87/36 |
| 3,892,161 | 7/1975 | Sokol | 87/44 X |
| 4,034,642 | 7/1977 | Iannucci et al. | 87/48 |
| 4,034,643 | 7/1977 | Iannucci et al. | 87/48 |
| 4,130,046 | 12/1978 | Sokol | 87/48 |

*Primary Examiner*—John Petrakes

[57] ABSTRACT

In a rotary braiding machine, a sleeve having a rounded forward portion is mounted on a stationary guide cylinder located on the center axis of the machine. The sleeve is driven reciprocatingly in the axial direction by a push rod which is coupled throgh a gear reduction mechanism to the ring gear of the machine so that the reciprocation of the sleeve is in timed relation with the rotation of the machine. The yarn or wire strand is supplied from two sets of bobbins which are driven along circular paths in opposing directions. When the reciprocating sleeve is in its retracted or rearward position, crossed strands from the bobbins approach the forward edge of the stationary guide cylinder. As the crossed strands reach the stationary guide cylinder, the reciprocating sleeve moves to its forward position lifting the strands away from the forward edge of the stationary guide cylinder. The rate of reciprocation of the sleeve is preferably in time with the crossings. However, it may be necessary to reciprocate the sleeve at two or three times the rate at which the strands cross each other so that the strands are lifted from the forward edge of the guide cylinder once or twice between strand crossings. This effects a "walking-beam" action of the strands on the edge of a guide cylinder which assists the strands to travel at a constant rate in a circular path about the center axis of the machine as they cross each other uninhibited.

14 Claims, 7 Drawing Figures

ROTARY BRAIDING MACHINE

BACKGROUND OF THE INVENTION

This invention relates to rotary braiding machines, and particularly to rotary wire-braiding machines of the type used in making braided-wire high-pressure hose.

In a typical rotary braiding machine, a pair of concentric coaxial plates or tables each carry a set of bobbins. The tables are rotated along circular paths in opposite directions about the center axis of the machine. A central cord or mandrel projects forwardly through a forward opening located on the center axis of the machine. The strands carried by the bobbins are drawn forwardly along convergent lines which come together just forward of the opening. The strands are interlaced or braided at the point of convergence about the center cord or mandrel. As the strands are pulled forwardly, they are drawn over the edge of a forwardly projecting stationary cylinder located on the center axis of the machine. Since the strands of the one set of bobbins are moving along a circular path in a direction opposite to that of the strands of the other set of bobbins, the strands of one set bear against the strands of the other set as they cross and this interference may result in a lack of uniformity which shows up as an imperfection in the braiding pattern.

The problem briefly described above was recognized by the prior art in U.S. Pat. No. 1,976,931 which issued to B. K. Ford on Oct. 16, 1934. In the Ford patent, a transverse slot having serrated edges is provided in the rotationally stationary cylinder over the forward edge of which the strands are drawn. A cam roller, secured to the rotational braider head, passes through the slot and causes the rotationally stationary cylinder to be moved reciprocatingly in the axial direction due to the engagement between the cam roller and the peaks of the serrations. This arrangement does not, however, permit the timing of the reciprocations to the crossings, nor the adjustment of the axial stroke, relative to the braid strand configuration which extends from the stationary guide cylinder to the braid point. This configuration changes with the specifications of the product being produced.

It is also believed that the prior art was intended to "beat" the braid formation off of a forming sleeve thereby slipping the formed braid on to the product. In contrast thereto, the present invention is directed to a mechanism in which the yarn or wire strands are braided right on the product which, in the case of wire braiding, may be a high pressure hose having a hollow rubber or fabric core.

SUMMARY OF THE INVENTION

An object is to provide, in a high-speed rotary braiding machine, an improved mechanism for insuring uniformity of braiding by assisting the strands of one set of bobbins to pass over the strands of the other set during rotation of the two sets of bobbins in opposite directions.

A further object is to provide means, in a rotary braiding machine, not only for assisting the strands of the one set of bobbins to pass over the strands of the other set, but also to reduce the resistance heretofore offered by the forward edge of the guide cylinder to lateral travel of the strands as they move along their circular paths.

The foregoing, as well as other objects and advantages of the present invention, are achieved by providing a sleeve having a forward portion with a rounded edge and mounting it on the forwardly projecting rotationally-stationary guide cylinder, and by providing rod means connected to said sleeve for reciprocating the sleeve axially at a rate which is in timed relation with the rate at which the strands of the one set of bobbins cross over the strands of the other set.

In an alternate embodiment, the rate of reciprocation of the sleeve is a multiple of two or three times the rate at which the strands of the one set of bobbins cross over those of the other, thereby to achieve a "walking-beam" action as the strands are drawn over the forward edge of the forwardly projecting rotationally-stationary coaxial cylinder. The term "walking-beam" is used here to refer to the repeated lifting and lowering of the strands from the forward edge of the rotationally-stationary cylinder to allow the strand, when lifted, to move along on its circular path without being retarded by the resistance introduced by the rubbing contact of the strands with the forward edge of the rotationally-stationary cylinder as the strands are drawn thereover and to allow opposingly moving strands to cross each other without being inhibited, thereby preventing the occurrence of braid imperfections.

DETAILED DESCRIPTION OF THE PREFERRED EMBODIMENT

Figure 1:
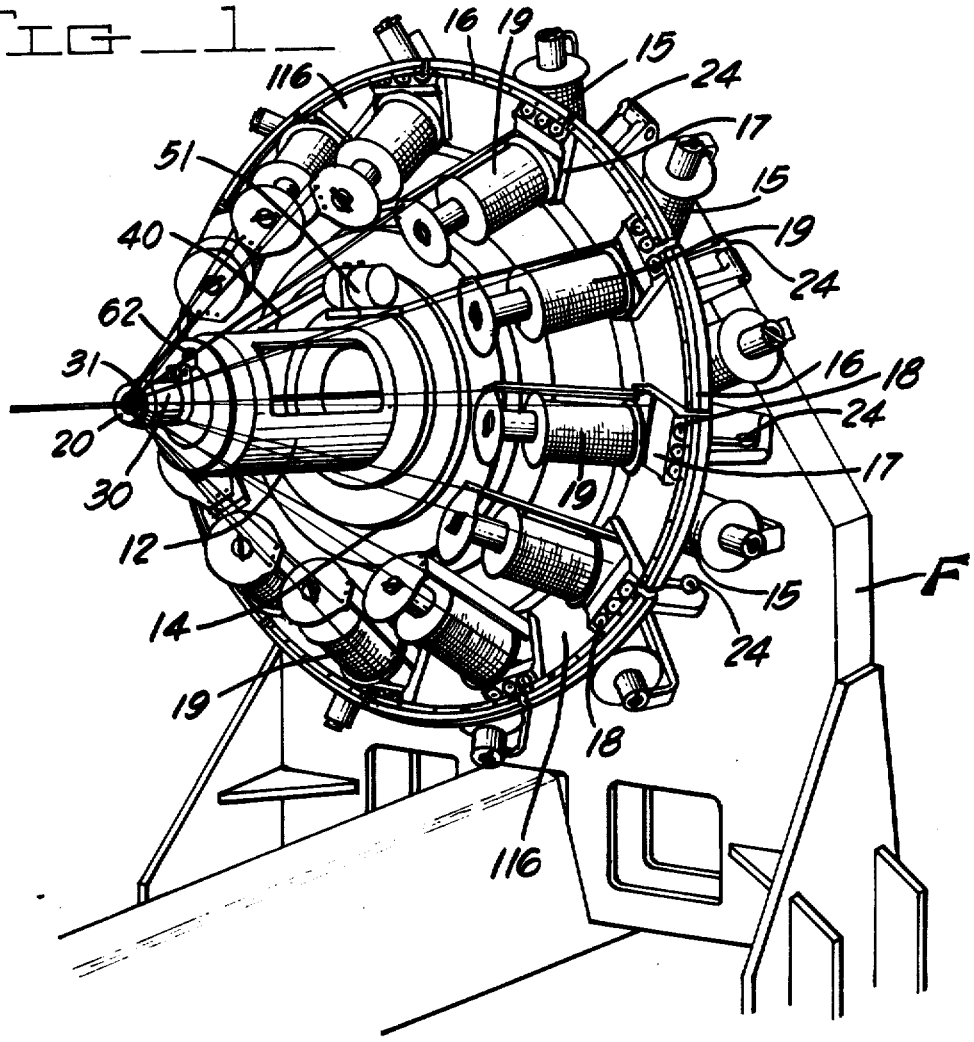
FIG. 1 is a perspective view of a rotary braiding machine into which the improvement provided by the present invention has been incorporated.
Figure 7:
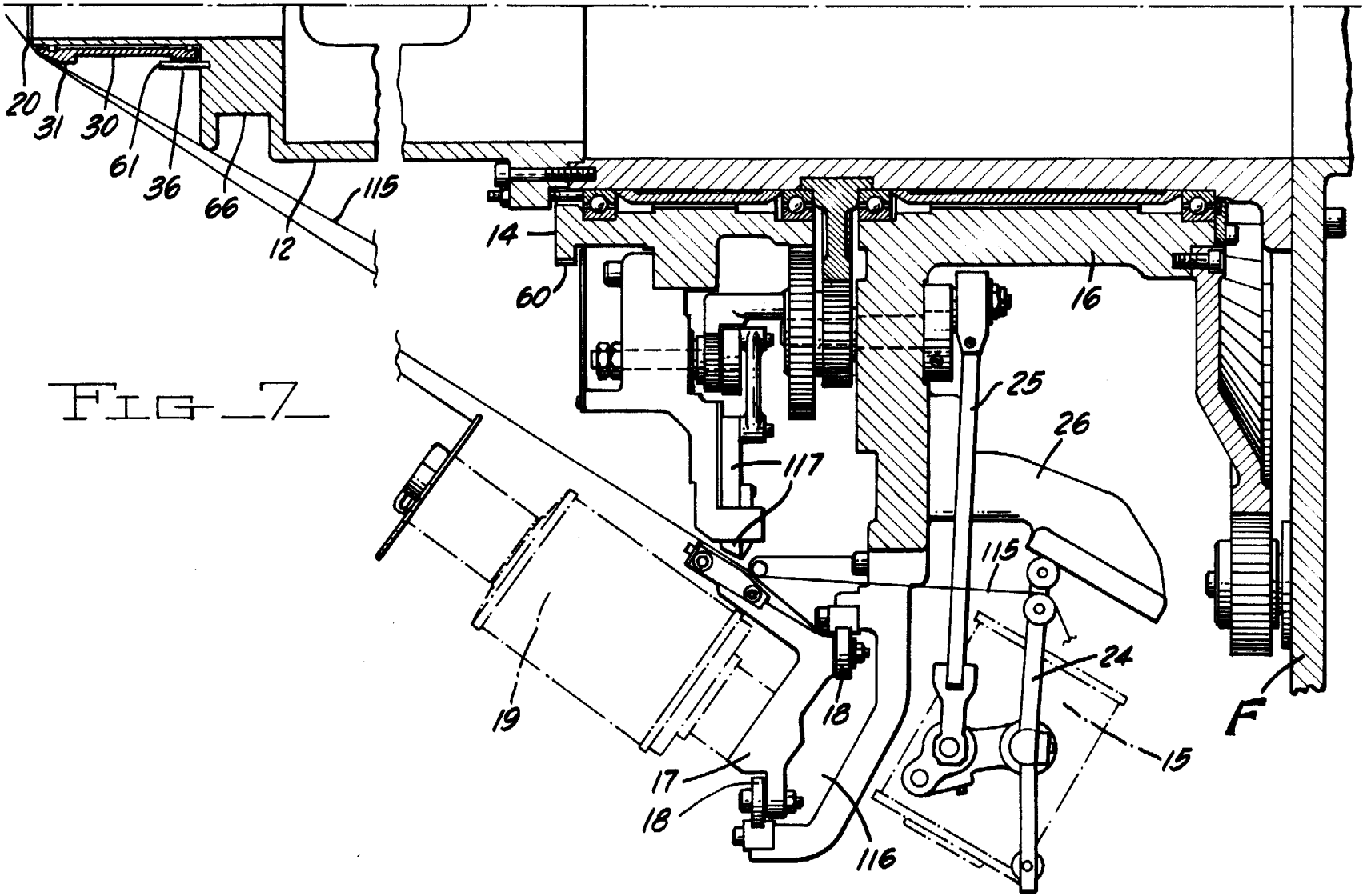
FIG. 7 is an elevational view, in section, of the lower half of the rotary braider shown in FIG. 1.

FIGS. 1 and 7 show a rotary braiding machine of the known type into which the improvement of the present invention has been incorporated. As shown, a frame F supports a fixed cylindrical member 12. Two annular tables, an inner table 14 and an outer table 16, are mounted on bearings for rotation in opposing directions about the fixed cylindrical member 12. An outer set of bobbins 15 are mounted on the outer table 16. The outer table 16 includes an annular track 116 in which carriers 17 having rollers 18 ride carrying the bobbins 19 of the inner set. The bobbins of the inner set 19 are pushed by dogs 117 of inner table 14 in a direction opposite to that in which the outer table 16 and the track 116 are moving. There are twelve bobbins in each set, but of course, this number may be different so far as the inventive concept is concerned.

Each of the bobbins carries multiple-filament strands of wire. For example, there may be eight filaments in each strand. The strands of wire of both sets of bobbins are drawn forwardly along convergent paths leading to the point of interlacing or braiding located just forward of the leading edge of a cylindrical rotationally-stationary member 20 which projects forwardly from fixed cylindrical member 12.

As the two sets of bobbins, the outer set 15 and the inner set 19 are rotated in opposing directions along circular paths, stands 115 of the outer set of bobbins 15 are lifted and lowered by strand guide means 24 which is driven by rod 25 as seen in FIG. 7. The timing arrangement of the strand guide means 24 is preferably such that the strands from the outer bobbins 15 are lifted to pass over two inner bobbins and then lowered to pass under two inner bobbins. In passing under the inner bobbins, the strands pass through slots under each inner bobbin. When the outer strand is not being passed under the inner bobbin, a pair of retractable dogs or fingers 117 project across the slot and engage the carrier 17 on which each inner bobbin is mounted. The dogs or fingers are carried by the inner rotating table 14 and their function is to push the carrier 17 rotationally along its circular path. To allow the strands from the outer bobbin to pass through the slot, the push dogs or fingers are retracted one at a time in timed relation with the passage of the wire through the slot.

The carrier 17 for the inner set of bobbins 19 is provided with rollers 18 which ride in track 116 on the table 16 which carries the outer set of bobbins 15. These outer bobbins 15 are supported on bracket 26 which projects from the underside of the track 116.

The rotary braiding machine shown in FIG. 1 and briefly described above is a known type of machine and no claims are directed to the apparatus described thus far.

Figure 2:
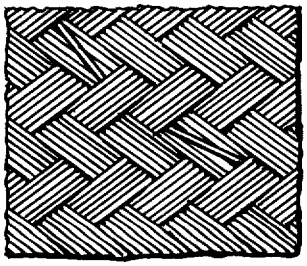
FIG. 2 is an illustration of a fragment of braided-wire hose showing the imperfections which occur in the absence of the improvement of the present invention.
Figure 3:
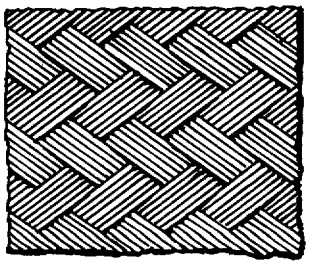
FIG. 3 is an illustration of a fragmentary view of a piece of braided-wire hose showing the uniformity in braiding which results when the improvement of the present invention is employed.

In operation, as the strands are pulled toward the point where interlacing and braiding takes place, the strands from the inner set of bobbins are travelling in a circular path in one direction while the strands from the outer set of bobbins are not only travelling in the opposite circular direction but are also being lifted and lowered by the strands guide mechanism 24 so that the outer strands pass over and under the strands from the inner set of bobbins. In a typical mode of operation, the strands from the outer bobbins are lifted over two consecutive inner bobbins and then under two consecutive bobbins. In this manner, interlacing and braiding occurs at the point where the strands converge to produce a fabric such as is illustrated in FIGS. 2 and 3. The product is a hollow cylindrical or tubular wire-braided fabric of great strength, useful as a high pressure hose.

Constructional details of the type of machine shown in FIGS. 1 and 7 are found in U.S. Pat. Nos. 4,034,642 and 4,034,643, each issued to Vincent Alfonzo Iannucci et al, and each assigned to Rockwell International Corporation, the assignee of the present application. The construction information disclosed in U.S. Pat. Nos. 4,034,642 and 4,034,643 is incorporated into the present application by reference.

In FIG. 1 of U.S. Pat. No. 4,034,642, the stationary cylindrical member (which is identified 12 in the present application) is also identified 12 in the '642 patent. In the '632 patent, a first table 18 has a series of brackets 32 which carry the outer set of bobbins identified 04. This table is driven rotationally by a motor 26, shown in FIG. 2, through a drive shaft 28. When the table 18 is driven for example, clockwise, a planetary gear 36 in the patent is caused to rotate on its shaft 34 by reason of the fact that planetary gear 36 is in engagement with sun gear 16 which is fixed to the stationary cylindrical member 12. Also mounted on shaft 34 is a larger gear 3[illegible] which, when driven rotationally as just described, causes a second table, identified 20 in the '642 patent, to rotate in the opposite or counterclockwise direction by reason of gear 38 being in mesh with ring gear 42. Thus, when the first table 18 is driven rotationally in the clockwise rotation by the main drive motor, the second table 20 is driven rotationally in the opposite or counterclockwise direction. The construction just described is similar to that shown in FIG. 7 of the present application.

In the '642 patent, mounted on the first table 18 which carries the outer set of bobbins 04, is a track, identified 44, comprising rails 46 and 48. The inner set of bobbins, identified 11, are mounted on a carrier 50 which is provided with an outer and inner rollers 52, 54 which ride in the track 44. FIG. 7 of this application shows similar construction.

In the other U.S. Pat. No. 4,034,643, the stationary cylindrical member is identified 14. The first table on which the other bobbins 22 are carried is identified 18, and the second table on which the inner bobbins 20 are carried is identified 19. In the '643 patent, projecting outwardly from table 18 are a series of support arms 24 on which the outer bobbins 22 are supported. The circular track on the outer table 18 is identified 34 in the '643 patent and is comprised of rails 36 and 38. The carrier for the inner bobbins is identified 40. The outer and inner rollers of carrier 40 are identified 42, 44.

In describing the machine of FIG. 1 of the present application, a brief reference was made to the fact that a pair of dogs or fingers extend across a slot through which the outer strands of wire are drawn as they pass under an inner bobbin. This mechanism is clearly shown in the '643 patent. In FIG. 1 of the '643 patent, strand 46 from the outer bobbin 20 is shown passing through a slot adjacent a slot fitting 72. The dogs 68 are retracted and extended in a reciprocating manner by the eccentric crank 64 and the linkage 80. The crank 64 is mounted on a shaft 62 which is driven rotationally by a planetary gear 66 which is in engagement with a ring gear 60. Thus, when the second table 19 is driven in a direction of travel opposite to that of the first table 18 by the gear means mounted on shaft 26, the planetary gear 66 on shaft 62 is rotated and crank 64 functions to retract and then extend the pair of push dogs 68, one at a time, in timed relation with the travel of the strand, thereby to allow the strand to pass through the slot but without disengaging the carrier 40 from the table 19. FIG. 7 of this application shows similar construction.

Having described the prior art machine in sufficient detail for the purpose of an understanding of the present invention, the improvement provided by the present invention will now be described. In so doing, reference will be made to FIGS. 4, 5 and 6 of the present application.

Figure 4:
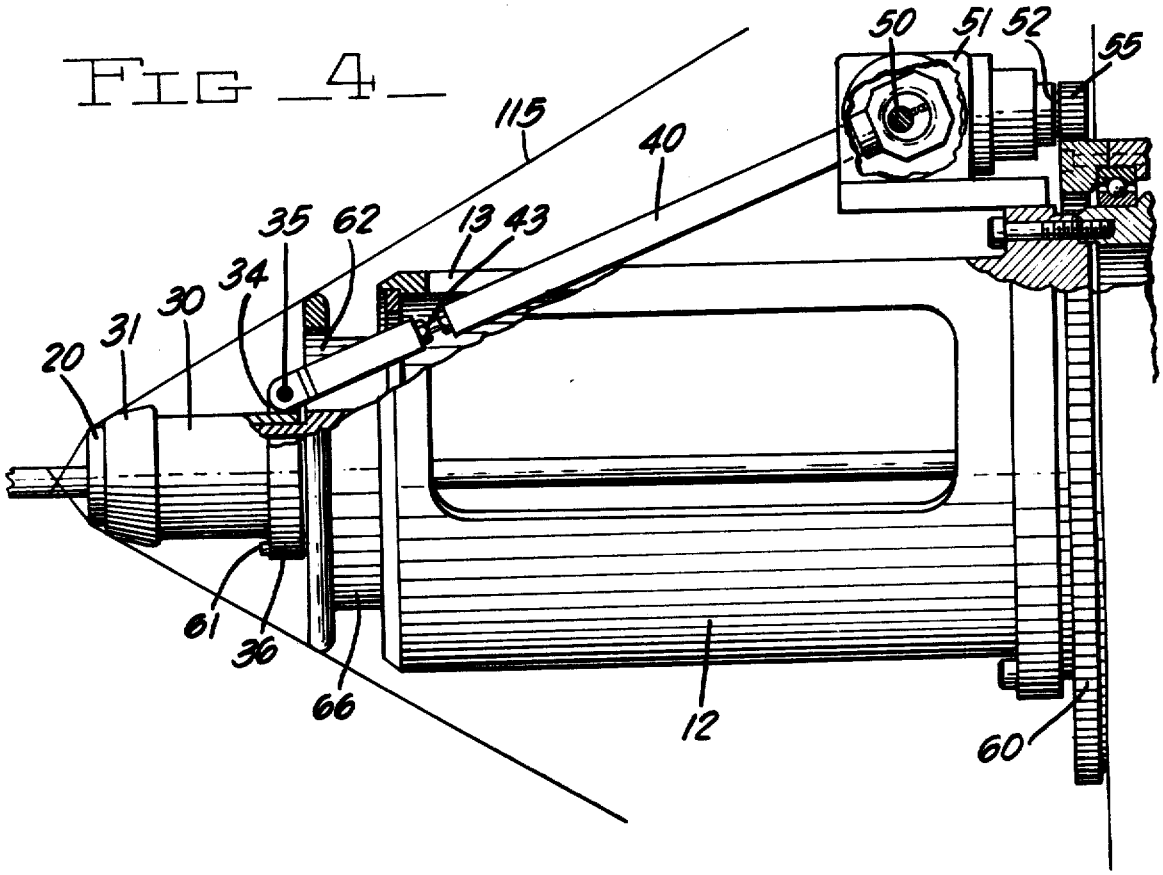
FIG. 4 is a side elevational view showing the mechanism provided by the present invention.
Figure 5:
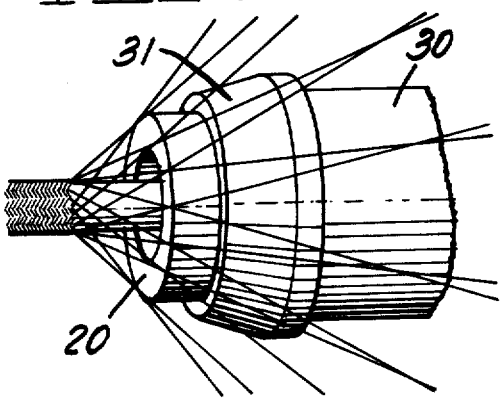
FIG. 5 is a schematic fragmentary view showing the reciprocable sleeve in retracted position.

As shown in FIG. 4, mounted on and projecting forwardly from the stationary cylindrical member 12 is a second stationary cylindrical member 20 having a diameter substantially smaller than that of cylindrical member 12. As illustrated in FIG. 5, the strands from the inner and outer sets of bobbins are drawn over the edge of the stationary cylindrical member 20 as the strands are pulled forward toward the point of braiding. Since the strands from one set of bobbins are travelling along a circular path in a direction opposite to that of the strands from other set of bobbins, it is apparent that the strands will have to cross each other and that in so doing, the travel of one strand may be retarded by the other. Moreover, even when the strands from the two sets of bobbins are not coming into contact with each other during crossing, the strands are being drawn over and are in contact with the leading edge of the rotationally-stationary cylindrical member 20. Hence, as the strands travel along their respective circular paths, their movement relative to the forward edge of the cylindrical member 20 is primarily lateral, and engagement of the strands against the forward edge of cylindrical member 20, and the crossing of opposingly-moving strands, introduces resistance and interference and has a retarding effect on the continued lateral travel of the threads. Thus a slight hesitation may occur with respect to one strand, or with respect to some of the filaments of a strand, and this will show up in the braided construction as an irregularity. This is illustrated in FIG. 2 of the drawing.

Figure 6:
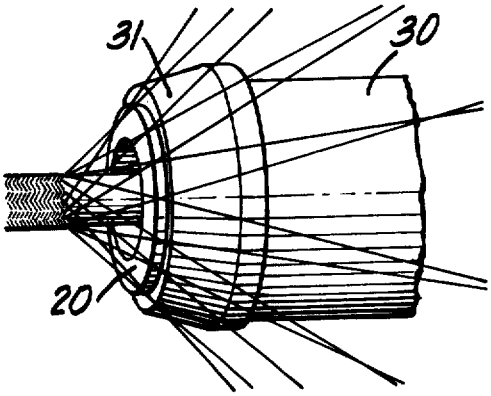
FIG. 6 is a schematic view similar to that of FIG. 5 but showing the sleeve in its forward position.

In accordance with the present invention, a sleeve 30 having secured thereto a rounded or tapered nose portion 31 is mounted on member 20, and a mechanism is provided for reciprocating the sleeve 30 in the axial direction. This is illustrated in FIGS. 5 and 6. In FIG. 5 the sleeve is shown in its retracted position. The forward position is shown in FIG. 6. This forward and rearward movement of sleeve 30 is repeated cylindrically in timed relation with the rotational travel of the inner and outer sets of bobbins. In moving to the forward position, the forward edge of the nose portion 31 of sleeve 30 engages the strands and lifts them from the forward edge of the member 20. When the sleeve 30 is retracted, the strands are returned to their positions of contact with member 20.

In a preferred method of operation, the strands are lifted from the forward edge of the stationary cylinder 20 at least once between each strand crossing. This feature, which has been referred to as a "walking-beam" action, has been found to reduce the amount of resistance to lateral travel introduced by the engagement of the strands with the forward edge of the stationary cylinder 20 and also to avoid the interference which would otherwise be introduced by the crossing of the strands.

The means for achieving reciprocation of sleeve 20 in timed relation with the travel of the inner and outer arrays of bobbins in opposite directions along circular paths will now be described. As shown in FIG. 4, a push rod 40 is connected pivotally at its forward end to an ear 34 which is an integral part of sleeve 30 located at the rearward upper end of the sleeve. Inserted in ear 34 is a pivot pin 35 to which the forward end of rod 40 is connected. At the lower part of the rearward end of sleeve 30 is a second ear 36 having a slot for receiving a fixed pin 61 which projects forwardly from the annular fixed support member 66 in which cylindrical member 30 is supported. Pin 61 in ear 36 prevents sleeve 30 from moving rotationally.

Push rod 40 extends rearwardly upwardly through slots 62 and 13 cut diagonally into the stationary cylindrical support members 66 and 12. The rearward end of push rod 40 is connected to an eccentric 50 which is driven by a right-angled gear reducer 51. Mounted on the rearwardly-extending input shaft 52 of gear reducer 51 is spur gear 55 which is in mesh with a ring drive gear 60. The ring drive gear 60 is a component part of the rotary braider and is mounted on and fixed to the same table 14 (FIG. 1) on which the inner array of bobbins 19 is mounted. Thus, an inner table 14 is rotated, the rotating ring gear 60 drives the spur gear 55 which in turn drives the right-angle gear reducer 51 which drives the eccentric 50. Rotation of eccentric 50 drives push rod 40 back and forth in reciprocating manner, thereby to move the collar 30 back and forth in timed relation with the rotation of the ring gear 60 and in timed relation with the tables on which the inner and outer array of bobbins are mounted.

For purposes of adjustment, a turn buckle 43 is provided which permits adjustments of the length of the push rod 40, thereby to adjust the position of the stroke of the reciprocating collar 30 relative to the fixed cylindrical member 20. Adjustments in phase can also be made by adjusting the eccentric 50, or by removing the spur gear 55 from the ring gear 60 and replacing it after rotating gear 55 and shaft 52.

In the drawings and in the text, the fixed cylindrical member 20 has been illustrated and described as being of substantially smaller diameter than the fixed cylindrical support member 12. This is not essential. In at least some cases, it may be preferable to have the diameter of the fixed cylindrical member 20 substantially larger than shown in FIGS. 1 and 4, although its diameter should be smaller, at least slightly, than the diameter of member 12.

While the present invention is particularly applicable to rotary braiding machines when used in the making of braided wire high-pressure hose, the invention may also be used to advantage in rotary braiding machines when used in the making of other tubular products including those made with textile strands.

What is claimed is:

1. In a rotary braiding machine having power means for rotating the machine and for drawing the strand from supply bobbins toward a point of convergence where interlacing and braiding takes place;

a. an outer set of bobbins carrying strands;

b. means mounting said outer set of bobbins for travel in one direction along a circular path concentric with the center axis of the machine;

c. an inner set of bobbins carrying strands;

d. means mounting said inner set of bobbins for travel along a circular path in a direction opposite to that of said outer set of bobbins;

e. outer strand guide means for guiding the strand from the outer set of bobbins over and under the bobbins of the inner set during rotation of the machine, thereby to cause interlacing between the strands of the inner and outer sets of bobbins as they travel in opposite directions;

f. a cylindrical guide member on the center axis of the machine projecting forwardly from the bobbin-mounting means toward the point of strand convergence, said strands being drawn over the forward edge of said cylindrical guide member as said strands move toward said point of convergence and interlacing;

g. a sleeve member mounted concentriclly on said cylindrical guide member; and h. means for providing relative reciprocating motion in the axial direction between said sleeve member and said guide member, whereby the forward edge of one of said members engages said strand when said one member is in its forward position eliminating strand contact with said other member but disengages from said strand when said one member is in its rearward position allowing strands to again contact said other member.

2. Apparatus according to claim 1, wherein said means for providing relative reciprocating motion comprises means for reciprocating said sleeve member on a fixed guide member.

3. Apparatus according to claim 2, wherein said means for reciprocating said sleeve member comprising:

a. an elongated rod;

b. means connecting the forward end of said rod pivotally to said sleeve member;

c. an eccentric;

d. means according the rearward end of said rod to said eccentric;

e. drive means connected between said eccentric and said mounting means for one of said sets of bobbins for driving said eccentric rotationally, whereby said rod is driven reciprocatingly in timed relation with the travel of said sets of bobbins along their respective circular paths.

4. Apparatus according to claim 3, wherein said elongated rod is adjustable in length, thereby to adjust the length of the reciprocating stroke of said sleeve member.

5. Apparatus according to claim 3, wherein said means connecting the forward end of said rod pivotally to said sleeve member comprises an ear which projects from said sleeve member and a pivot pin through said ear connecting said rod to said ear.

6. Apparatus according to claim 5, wherein said sleeve member is provided with a second ear having a slot therein adapted to receive a fixed pin for preventing rotation of said sleeve member.

7. Apparatus according to claim 1, wherein the forward portion of said sleeve member is rounded.

8. Apparatus as claimed in claim 1, wherein said drive means is connected between said eccentric and said means for mounting the said inner set of bobbins.

9. Apparatus according to claim 1, wherein said drive means connected between said eccentric and said mounting means includes a ring gear on said inner-bobbin mounting means, a spur gear in engagement with said ring gear, and means connecting said spur gear to said eccentric.

10. Apparatus according to claim 9, wherein said means connecting said spur gear to said eccentric includes a right-angled gear reducer.

11. Apparatus according to claim 1, wherein the rate of reciprocation is relative to the crossings.

12. Apparatus according to claim 1, wherein the rate of reciprocation is a multiple of the rate at which strands from said outer set of bobbins cross over the strands of said inner set of bobbins.

13. Apparatus according to claim 12, wherein said multiple is at least two.

14. Appratus according to claim 1, wherein means are provided for preventing rotational movement of said sleeve member.

* * * * *